US005097552A

United States Patent [19]

Viesturs

[11] Patent Number: 5,097,552

[45] Date of Patent: Mar. 24, 1992

[54] INFLATABLE AIR MATTRESS WITH STRAPS TO ATTACH IT TO A CONVENTIONAL MATTRESS

[75] Inventor: Eric Viesturs, Village Southbury, Conn.

[73] Assignee: Connecticut Artcraft Corporation, Naugatuck, Conn.

[21] Appl. No.: 772,683

[22] Filed: Oct. 7, 1991

[51] Int. Cl.[5] ..... A47C 27/08; A61G 7/057

[52] U.S. Cl. ..... 5/449; 5/496

[58] Field of Search ..... 5/449–458, 5/441, 496, 498

[56] References Cited

U.S. PATENT DOCUMENTS

| | | | |
|---|---|---|---|
| 2,201,424 | 5/1940 | Berger | 5/451 |
| 3,802,004 | 4/1974 | Whitney | 5/452 |
| 3,829,918 | 8/1974 | Stamberger | 5/454 |
| 3,958,286 | 5/1976 | Rodinsky | 5/451 |
| 4,056,858 | 11/1977 | Weber | 5/458 |
| 4,190,915 | 3/1980 | Birt | 5/505 |
| 4,336,621 | 6/1982 | Schwartz et al. | 5/496 |
| 4,454,615 | 6/1984 | Whitney | 5/449 |
| 4,611,357 | 9/1986 | Chelin | 5/451 |

*Primary Examiner*—Alexander Grosz

[57] ABSTRACT

An inflatable air mattress adapted to be securely disposed on top of a conventional mattress for proper support of a patient employs a first upper air impervious rectangularly shaped flexible layer having opposite ends and opposite sides and a second lower air impervious rectangularly shaped flexible layer having like opposite ends and like opposite sides. The peripheries of the first and second layers are joined together in air impervious sealed relationship. The first and second layers are also joined together in air impervious sealed relationship in small selected areas spaced from each other and from said peripheries. An air inlet port is secured to the second layer and communicates with the interior of the layers. An air outlet port spaced from the inlet port is also secured to the second layer and communicates with the interior of the layers. First and second spaced strap engaging members are secured to the second layer adjacent one side of the second layer. Third and fourth spaced strap engaging members are secured to the second layer adjacent the opposite side of the second layer. The third member is horizontally aligned with the first member and the fourth member is horizontally aligned with the second member.

1 Claim, 1 Drawing Sheet

INFLATABLE AIR MATTRESS WITH STRAPS TO ATTACH IT TO A CONVENTIONAL MATTRESS

BACKGROUND OF THE INVENTION

Patients who are bedridden for appreciable periods of time often develop persistent and painful bedsores ∂decubitus ulcers[. It is generally believed that the bedsores are produced by relatively high pressures exerted upon the body by a conventional mattress in body regions where these regions engage the mattress. In order to inhibit the development of bed sores, it is known that certain types of air filled mattress, designed to minimize these pressures, can be disposed on top of the conventional mattress so that the patient lies on top of the air filled mattress and the body regions engage the air filled mattress and are subject to relatively low pressures rather than engaging the conventional mattress and being subject to the relatively high pressures.

However, as a nurse moves or shifts the patient in position, the air filled mattress is also moved in relationship relative to the conventional mattress on which the patient rests. This movement is always undesirable, but can also be sufficiently large to cause the patient to slip off the air mattress or to cause both the patient and the air mattress to slip off the conventional mattress.

The present invention is directed toward a new type of air filled mattress construction which enables the air mattress to be firmly secured to the conventional mattress in such manner that the air mattress cannot be moved in position relative to the conventional mattress on which it rests, regardless of any patient movement or shift in position.

SUMMARY OF THE INVENTION

In accordance with the principles of the invention, an inflatable air mattress is adapted to be securely disposed on top of a conventional mattress for proper support of a patient. To this end, the air mattress comprises a first upper air impervious rectangularly shaped flexible layer having opposite ends and opposite sides and a second lower air impervious rectangularly shaped flexible layer having like opposite ends and like opposite sides. The peripheries of the first and second layers are joined together in air impervious sealed relationship. The first and second layers are also joined together in air impervious sealed relationship in small selected areas spaced from each other and from the peripheries of the layers.

An air inlet port is secured to said second layer and communicates with the interior of the layers. An air outlet port spaced from the inlet port is also secured to said second layer and communicates with the interior of the layers;

First and second spaced strap engaging means are secured to the second layer adjacent one side of the second layer. Similarly, third and fourth spaced strap engaging means are secured to the second layer adjacent the opposite side of the second layer. The third means is horizontally aligned with the first means and the fourth means is horizontally aligned with the second means. Preferably, the first and second means extend beyond the one side of the second layer and the third and fourth means extend beyond the other side of the second layer.

In use, the air mattress is placed upon the conventional mattress in desired position. A first strap, adjustable in length, extends underneath the conventional mattress and upwardly across the opposite sides of this mattress to engage at each end a corresponding one of the first and third means. A second strap, adjustable in length extends underneath the conventional mattress and upwardly across the opposite sides of this mattress to engage at each end a corresponding one of the second and fourth means. The straps are tightened as necessary for firmly secure the air mattress in position on top of the conventional mattress, thus preventing any shifting of position of the air mattress relative to the conventional mattress regardless of patient movement or shift in position.

DETAILED DESCRIPTION OF PREFERRED EMBODIMENTS

Figure 1:
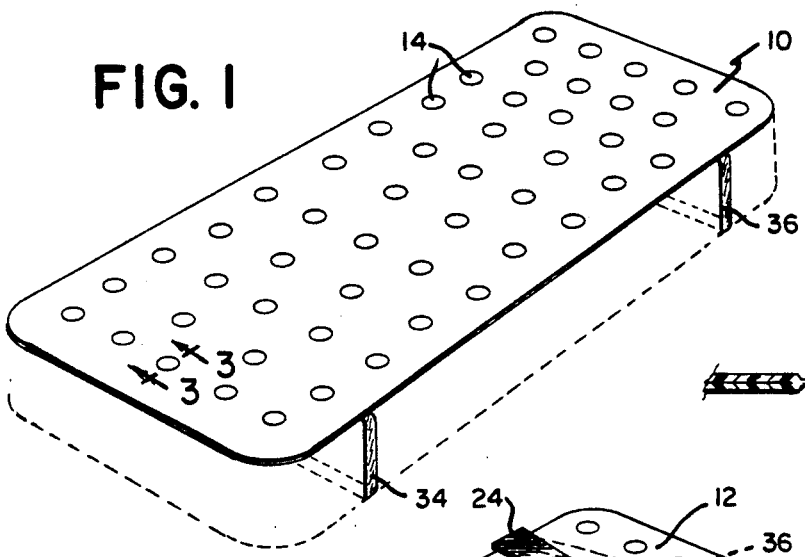
FIG. 1 is a perspective view of a preferred embodiment of the invention shown in position for use.
Figure 3:
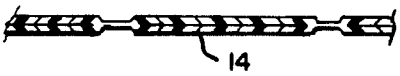
FIG. 3 is a detail cross section taken along line 3—3 in FIG. 1.
Figure 2:
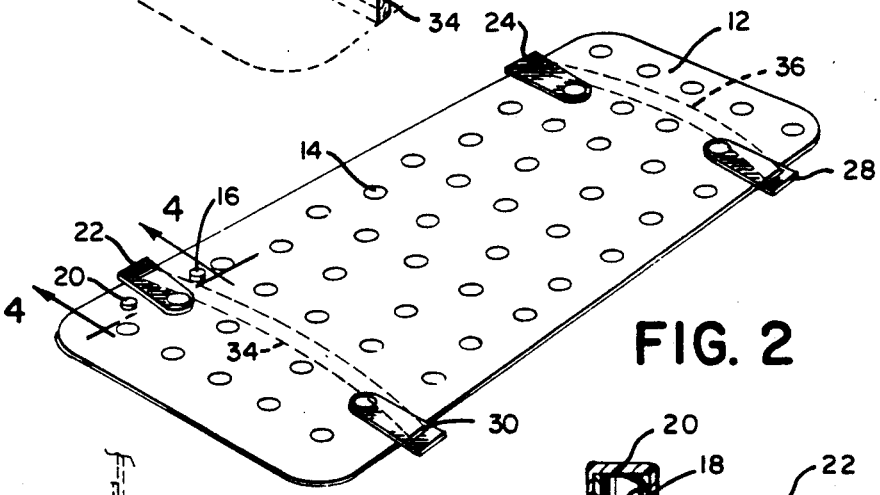
FIG. 2 is a bottom view of the air mattress shown in FIG. 1.
Figure 4:
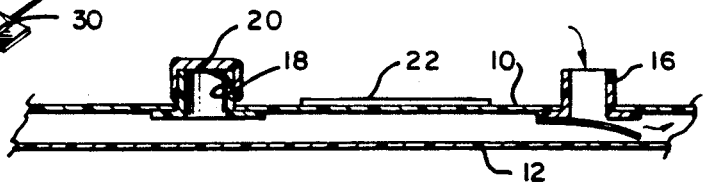
FIG. 4 is a detail cross section taken along line 4—4 in FIG. 2.

Referring now to FIGS. 1–4, a first upper or top air impervious rectangularly shaped flexible layer 10 has opposite sides and opposite ends. A second lower or bottom air impervious rectangularly shaped flexible like layer 12 is spaced below the layer 10, the peripheries of the first and second layers being joined together in air impervious sealed relationship. Typically, these layers are of like plastic and are welded together. In addition, these layers have small spaced aligned circular areas 14 which are joined peripherally together in air impervious sealed relationship. The interior spaces in such areas contain air but are not inflatable. The mattress so formed can be inflated by feeding air into the region between the layers via air inlet port 16. Port 16 can have a one way valve which prevents air from escaping from the mattress therethrough. Normally closed air outlet port 18 can be opened by removing an outer screw cap 20 to allow the air to escape.

First, second, third and fourth flat plastic members 22, 24, 26 and 28 are each joined at one end in sealed relationship to a corresponding one of areas 14 on the outside of the bottom layer. Members 22 and 24 are disposed adjacent opposite ends of the layer 12 and extend outwardly beyond one side in parallel positions. Members 26 and 28 are disposed adjacent opposite ends of the layer 12 and extend outwardly beyond the other side in parallel positions. Each outwardly extending end of each of these members has a slot 30. Members 22 and 26 are horizontally aligned. Members 24 and 28 are horizontally aligned.

In use, the air mattress is placed on top of a conventional mattress 32 so that the slotted end of each of the members 22, 24, 26 and 28 extends outwardly past the corresponding side of mattress 32. A first strap 34 extends underneath the mattress 32 and upwardly across both sides of the mattress, being secured at one end to member 22 by extending through its slot and being secured in similar manner at the other end to member 26. A second strap 36 is connected in the same manner to members 24 and 26.

Figure 5:
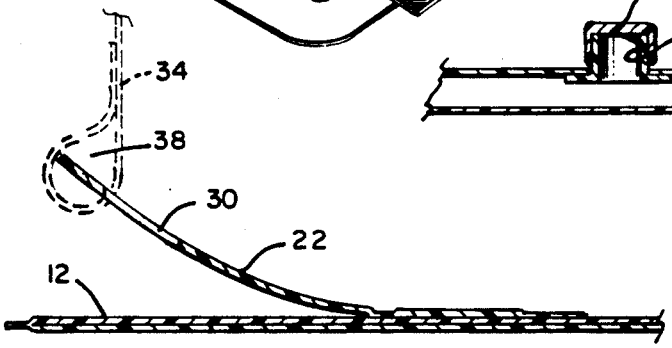
FIG. 5 is a detail view illustrating the connection of a strap to a strap engaging means.

These straps are adjustable in length and can be tightened as necessary. The straps can have hook and loop type coatings so that each end can be folded after extending through a member slot to engage the body of the strap as shown at 38 in FIG. 5.

What is claimed is:

1. An inflatable air mattress adapted to be securely disposed on top of a conventional mattress for proper support of a patient, said mattress comprising:

a first upper air impervious rectangularly shaped flexible layer having opposite ends and opposite sides;

a second lower air impervious rectangularly shaped flexible layer having like opposite ends and like opposite sides, the peripheries of the first and second layers being joined together in air impervious sealed relationship, the first and second layers being also joined together in air impervious sealed relationship in small selected areas spaced from each other and from said peripheries;

an air inlet port secured to said second layer and communicating with the interior of the layers;

an air outlet port spaced from the inlet port, said outlet port being secured to said second layer and communicating with the interior of the layers;

first and second spaced strap engaging means secured to the second layer adjacent one side of the second layer and extending beyond said one side;

third and fourth spaced strap engaging means secured to the second layer adjacent the opposite side of the second layer and extending beyond said opposite side, the third means being horizontally aligned with the first means, the fourth means being horizontally aligned with the second means; and first and second straps of adjustable length, the first strap being adapted to cooperate with the aligned first and third means, the second strap being adapted to cooperate with the aligned second and fourth means, each of the first and second straps being adjustable with the aid of hook and loop type fasteners positioned on the first and second straps.

* * * * *